United States Patent [19]

Tsai

[11] 4,361,206

[45] Nov. 30, 1982

[54] EXHAUST MUFFLER INCLUDING VENTURI TUBE

[75] Inventor: Shyan S. Tsai, Longview, Tex.

[73] Assignee: Stemco, Inc., Longview, Tex.

[21] Appl. No.: 183,404

[22] Filed: Sep. 2, 1980

[51] Int. Cl.[3] ..... F01N 1/08

[52] U.S. Cl. ..... 181/255; 181/272

[58] Field of Search ..... 181/247, 255, 264, 269, 181/272

[56] References Cited

U.S. PATENT DOCUMENTS

| | | | |
|---|---|---|---|
| 992,839 | 5/1911 | Wolle | 181/264 |
| 1,876,861 | 9/1962 | Compo . | |
| 1,881,051 | 10/1932 | Haas | 181/264 |
| 2,235,705 | 3/1941 | Haas et al. . | |
| 3,672,464 | 6/1972 | Rowley | 181/253 |
| 3,679,024 | 9/1970 | Kirkland . | |
| 4,267,899 | 5/1981 | Wagner et al. | 181/272 |

FOREIGN PATENT DOCUMENTS

| | | | |
|---|---|---|---|
| 226480 | 8/1962 | Austria | 181/264 |

*Primary Examiner*—L. T. Hix
*Assistant Examiner*—Thomas H. Tarcza
*Attorney, Agent, or Firm*—Woodcock, Washburn, Kurtz, Mackiewicz & Norris

[57] ABSTRACT

A muffler comprising a housing having inlet and outlet ends and having a venturi tube of smaller diameter than the housing disposed therewithin in communication with its outlet end is disclosed. The venturi comprises a first bell reducer, which reduces the cross-sectional area of the venturi to substantially half its original value, a straight tubular section of cross-sectional area equal to the reduced area and of as great length as possible within the venturi, and a gradually diverging section connecting the straight section of reduced area to a perforate tube, of substantially equal area as the inlet of the venturi and communicating with the outlet of the housing. Several distinct embodiments of the invention are disclosed, which vary by means causing additional diversion of the gases from their straight path.

7 Claims, 7 Drawing Figures

EXHAUST MUFFLER INCLUDING VENTURI TUBE

FIELD OF THE INVENTION

This invention relates to the field of mufflers for attenuating the sound produced by the exhaust from internal combustion engines. More particularly, this invention relates to the field of mufflers for heavy truck engines.

BACKGROUND OF THE INVENTION

In recent years, it has become increasingly necessary to provide improved mufflers for the attenuation of the exhaust noise produced by internal combustion engines used in transportation vehicles, due to public outcry resulting in government regulations. New regulations are almost continually being proposed which require ever more stringent noise standards, particularly as applied to heavy truck engines. Accordingly, it is necessary that the mufflers now available for truck engines be improved prior to implementation of these newer regulations.

Attenuation of sound can be accomplished in a variety of ways, but the constraints on designing a muffler for a transportation vehicle are such that limited methods of attenuation can be used. Inasmuch as a muffler for a transportation vehicle must be compact, inexpensive, durable under attack of hot and corrosive exhaust gases, and impervious to vibration and exposure to the weather, specialized attenuation means are generally used.

The sound to be attenuated is also of considerable significance in the design of an exhaust muffler. It will be understood that the exhaust noise from an internal combustion engine is typically comprised of a plurality of components, each of a specific frequency, which must each be attenuated. In accordance with well known prior art principles, attenuation of a wave may be accomplished by causing the wave to undergo a sufficient number of phase changes as to destroy the coherence of the wave; in the exhaust case, this turns the individual wave components of high amplitude into a multiplicity of waves of lesser amplitude, thus lowering the overall noise level. Accordingly, it is known in the art that mufflers to be efficient must comprise numerous means for alteration of the phase relationships of the individual waves making up the overall exhaust note.

Numerous prior art expedients are known for altering the phase relationship of sound waves. For example, it is known that to force incoming exhaust gases to make sharply angled turns alters the phase relationship, as does passing the gas flow through tubes of decreasing or increasing cross-sectional area. Other expedients include reflecting the gases from a terminus, thus causing them to interact with one another to create cancellation by means of destructive interference. Wave energy may also be absorbed by certain compressible materials, thus attenuating the wave energy. The exhaust flow may also be divided between two flow paths of differing length, thus causing destructive interference upon recombination of the diverted waves. Another possibiity is to incorporate a step in the exhaust passage, which also causes attenuation.

Numerous prior art disclosures show various combinations of these elements; see, for example, U.S. Pat. Nos. 1,881,051 and 2,235,705 to Haas which rely upon convoluted and plural flow paths to achieve attenuation. See also, U.S. Pat. No. 3,679,024 to Kirkland, Jr. et al., which shows a muffler providing an "S"-shaped flow pattern to the gases as well as using a venturi to throttle the gas flow.

A particularly relevant prior art patent is U.S. Pat. No. 3,672,464 to Rowley et al. which shows the use of a gradually divergent venturi following a sharply-contoured bell reducer used in conjunction with means for dividing the flow between paths of differing lengths to provide cancellation of the waves upon recombination.

A further consideration which is important, particularly in the heavy transportation context, is the provision of a muffler which provides efficient attenuation while not causing undue back pressure to the engine; that is, one which does not provide good muffling at the expense of engine operation efficiency.

OBJECTS OF THE INVENTION

It is accordingly an object of the invention to provide an improved muffler for an internal combustion engine.

It is a further object of the invention to provide an improved muffler for internal combustion engines which provides additional attenuation over prior art mufflers, but which does not cause a reduction in operating efficiency of the engine with which it is used.

Still another object of the invention is to provide a muffler which provides better attenuation of sound than is possible in the prior art without imposing an engine efficiency or cost penalty.

SUMMARY OF THE INVENTION

The above mentioned objects of the invention and needs of the art are satisfied by the present invention, according to which a muffler comprises a housing having inlet and outlet ends and having a venturi tube of smaller diameter than the housing disposed therewithin in communication with its outlet end. The venturi comprises a first bell reducer, which reduces the cross-sectional area of the venturi to substantially half its original value, straight tubular section of cross-sectional area equal to the reduced area and of as great length as possible within the venturi, and a gradually diverging section connecting the straight section of reduced area to a perforate tube, of substantially equal area as the inlet of the venturi and communicating with the outlet of the housing. Several distinct embodiments of the invention are disclosed, which vary by means causing additional diversion of the gases from their straight path.

BRIEF DESCRIPTION OF THE DRAWINGS

The invention will be better understood if reference is made to the accompanying drawings in which.

DESCRIPTION OF THE PREFERRED EMBODIMENTS

As discussed above, the manufacture of a muffler for the attenuation of exhaust noise produced by an internal combustion engine involves the combination of a number of elements, each designed to alter the phase relationships of the individual acoustic waves of differing frequencies making up the overall exhaust note of the engine. The overall efficacy of attenuation provided by the muffler will depend in detail upon the combination of elements used. The present invention relates to the discovery by the inventor that a particularly useful combination for an internal venturi tube aligned with the outlet of a housing defining an overall muffler structure is a generally bell-shaped reducer, which approximately halves the cross-sectional area of the gas flow duct, followed by a straight section of tube of the diameter of the outlet side of the reducer, followed by a gentle diffuser gradually increasing the diameter of the tube from the diameter of the straight section to a larger diameter comparable to the original diameter of the bell-shaped reducer, followed by a perforate tube of considerable length terminating at the outlet end of the muffler. Several distinct embodiments of this general concept may be used and are described hereinafter. The invention may also have utility with respect to mufflers of other than generally axial flow, though this embodiment is of particular utility in the muffling of the exhausts of heavy truck engines.

Figure 1:
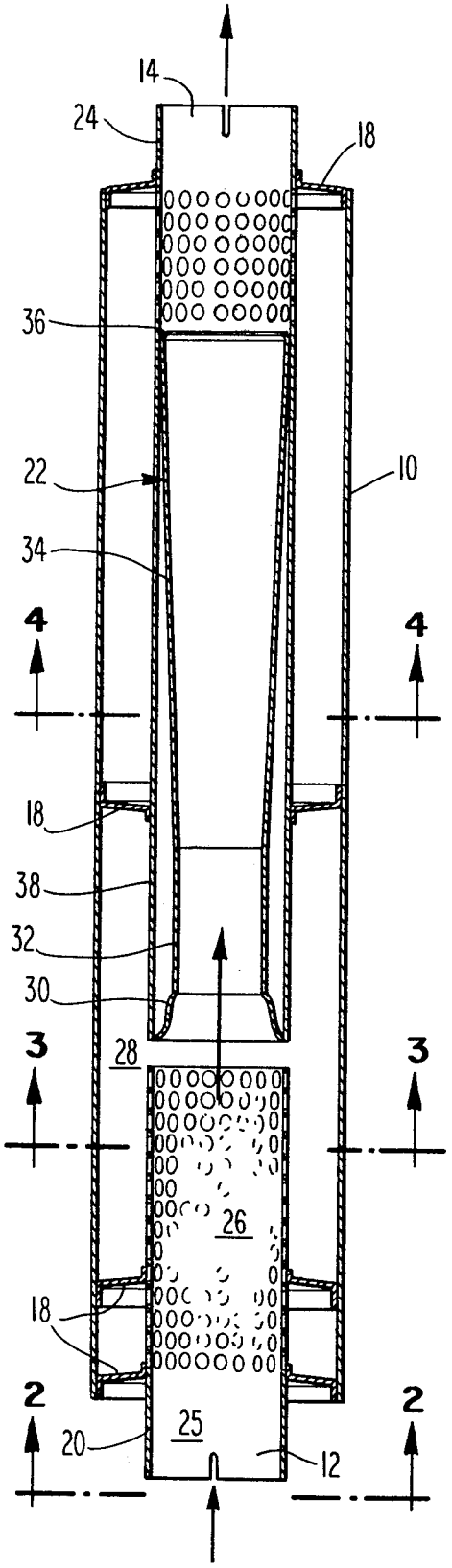
FIG. 1 represents a cross-sectional view of a first embodiment of the muffler of the invention.

Referring now to FIG. 1, a cross-sectional view of one embodiment of the muffler according to the invention is shown. The muffler comprises a generally cylindrical housing 10 having an inlet 12 and an outlet 14 and comprising a plurality of baffles 18 which support a generally tubular inner structure which comprises, in the embodiments of the invention shown in the Figures, an inlet tube 20, a venturi tube 22 and an outlet tube 24, all of which may preferably be axially aligned for substantially straight-through exhaust gas flow, so as to avoid the build up of back pressure thus reducing the efficiency of an engine.

In the embodiment shown in FIG. 1 as well as in the other embodiments described hereinafter, the inlet tube 20 comprises a section 25 adapted to be connected to an exhaust manifold and a section 26 which is a generally perforate tube. As shown, the perforations may extend substantially all the way around the tube.

The inlet tube 20 is separated by a gap indicated at 28 from the next section of the muffler, the venturi 22. The gap 28 causes a further phase change and attenuation. The venturi 22 comprises several sections of which the first is a generally bell-shaped reducer 30. The shape shown in FIG. 1 is the preferred embodiment of this reducer 30, though it may also be frustroconical or semispherical. The reducer 30 communicates with a section of straight tube 32 of reduced diameter as compared with the inlet end of the bell-shaped reducer 30 and the intake tube 20. Preferably, the cross-sectional area of the straight section of tube 32 is no greater than about half that of the inlet of the bell-shaped reducer 30. It is believed by the applicant that the combination of the bell-shaped reducer 30 and the straight tube 32 permit an efficient and well defined reflection of at least part of the incoming sound wave at the interface between the bell-shaped reducer 30 and the straight section 32. Were the bell-shaped section 30 connected directly to the next portion of the muffler, without the straight section 32, it might be that the wave would not be sufficiently coherent to cause significant reflection and cancellation of wave energy.

The straight section of tube 32 is connected to a gradually diverging frustroconical section of tubing or diffuser 34 which connects the reduced diameter section 32 to an outlet tube 24 of substantially the same diameter as the inlet of the bell reducer 30. In a preferred embodiment, both the straight section 32 and the diffuser 34 are as long as possible given the constraints of the overall package, i.e. to increase attenuation without loss of efficiency due to increased back pressure. As shown in FIG. 1, the gradually diverging section of tube 34 may be terminated with a slightly converging section 36 for ease of assembly of the venturi 34 within a straight section of tube 38; as shown in the drawing, the converging section 36 is of a comparatively small dimension so as to not have a substantial effect on the progress of the exhaust gases through the muffler. The termination of the venturi section 22 mates with a final outlet tube 24 which may be integrally formed with tube 38, as shown, for convenience, and which has perforations formed in that portion thereof which is within the housing 10 and is adapted to mate with a final termination of the exhaust system.

As is presently common practice in the truck muffler manufacturing art, all parts of the muffler of the invention may be made of a mild steel having an aluminum coating thereon for corrosion resistance. Alternatively, the outer housing 10 can be formed of a double layer construction, in which the outer layer may be of stainless steel for corrosion resistance and for improvement of appearance. A layer of a damping material such as asbestos or fiberglass may be interposed between the two layers for heat and sound insulation.

In the preferred embodiment, wherein the overall length of the muffler housing 10 is on the order of 45 inches, the length of the sections of the venturi 22 are as follows. The intake bell 30 is approximately 2¼ inches long; the straight section 32 is approximately 5 inches long, and the diverging section 34 is approximately 19 inches long. It appears to the inventor that the longer the straight section and the diffuser may be made, given the constraints of fitting the overall muffler package within the room allotted for it, the better. This will be explained below in connection with certain tests which have been performed on mufflers according to the present invention. However, it appears desirable that the ratio of the length of the diffuser section 34 to that of the straight section 32 be at least about 3:1 and that as disclosed above the ratio of the area of the outlet of the diffuser 34 to that of the straight section of tube 32 (i.e., to that of the inlet of the diffuser (34) be about 2:1; where the tube sections are radially symmetric, this implies radii in the ratio of about 1.4:1. However, it is believed that the teachings of the present invention are equally applicable to, for example, generally elliptically shaped mufflers.

Figure 4:
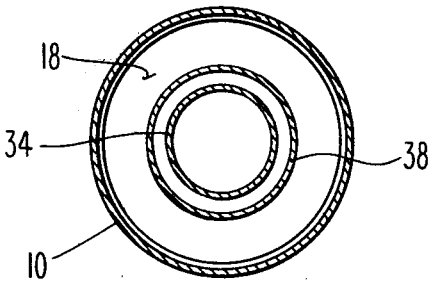
FIG. 4 represents a second cross-sectional view taken along the line 4—4 of FIG. 1.
Figure 3:
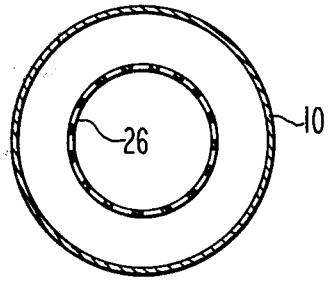
FIG. 3 represents a cross-sectional view taken along the line 3—3 of FIG. 1.
Figure 2:
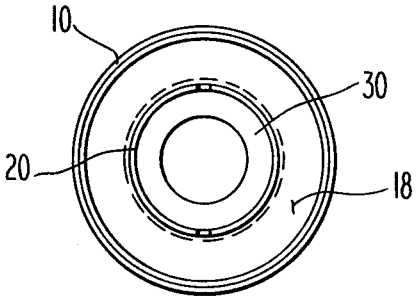
FIG. 2 represents an end view taken along the line 2—2 of FIG. 1.

Reference will now be made to FIGS. 2, 3 and 4 for cross-sectional views of the muffler of FIG. 1. FIG. 2 is an end view taken along the line 2—2 of FIG. 1 showing the outer housing 10, the baffle 18 appearing at the end, the inlet tube 20 and the reducing bell 30 which forms the first section of the venturi 22.

FIG. 3, a cross-section taken along the line 3—3 of FIG. 2, shows the outer housing 10 and the perforated portion 26 of the inlet tube 20.

Finally, FIG. 4 is a cross-section taken along the line 4—4 of FIG. 1, and shows the housing 10, a baffle 18, the support tube 38 which carries the reducing bell 30 (not shown in FIG. 4), and the diffusing portion 34 of the venturi 22.

Figure 5:
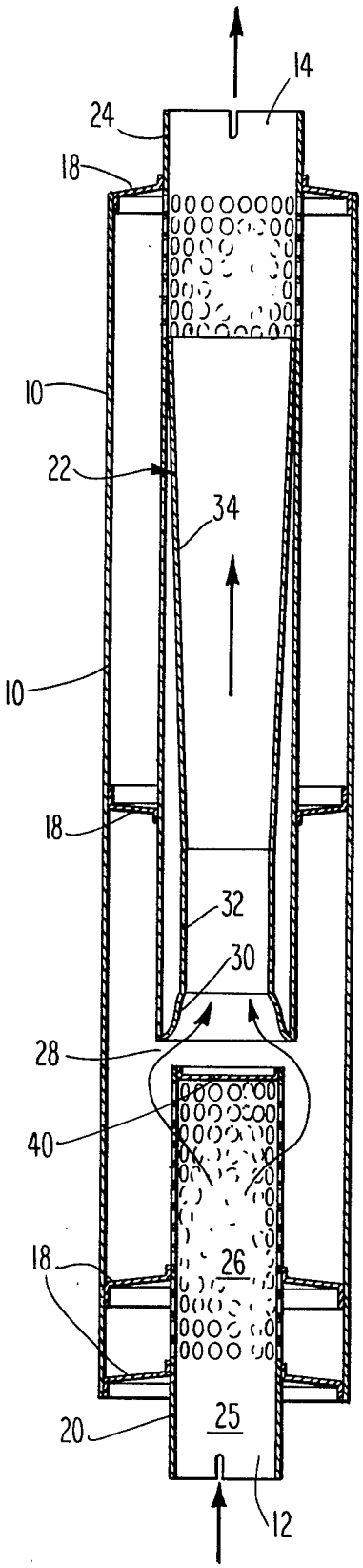
FIGS. 5, 6 and 7 are respectively cross-sectional views of second, third and fourth embodiments of the muffler according to the invention.

FIG. 5 shows a second embodiment of the muffler according to the invention. This muffler is generally similar to the embodiment shown in FIG. 1, and comprises an inlet portion 20 having a perforated portion 26 communicating after a short gap 28 with a reducing bell 30, connected to a straight section of reduced diameter 32, connected in turn to a gentle diffuser 34 which eventually communicates with an outlet section 24 having a perforated area formed therein. The primary distinction between the embodiments of FIGS. 1 and 5 is that a block 40 is placed at the end of the perforated portion 26 of the inlet tube 20. This causes all gas flow to be diverted around the block 40 through the perforations formed in the inlet tube 20, as indicated by the arrows. This, it will be understood by those skilled in the art, causes an additional change in impedance of the muffler to flow which causes an additional phase change in the sonic wave during its propagation, thus providing additional attenuation. Another change is that the diameter of the inlet tube 20, including the perforate section 26, is smaller in the embodiment of FIG. 5 then in FIG. 1. The significance of this modification is discussed below. The choice between the embodiments of FIGS. 1 and 5 can be made on the basis of test results with individual engines, each of which have differing exhaust noise characteristics.

Figure 6:
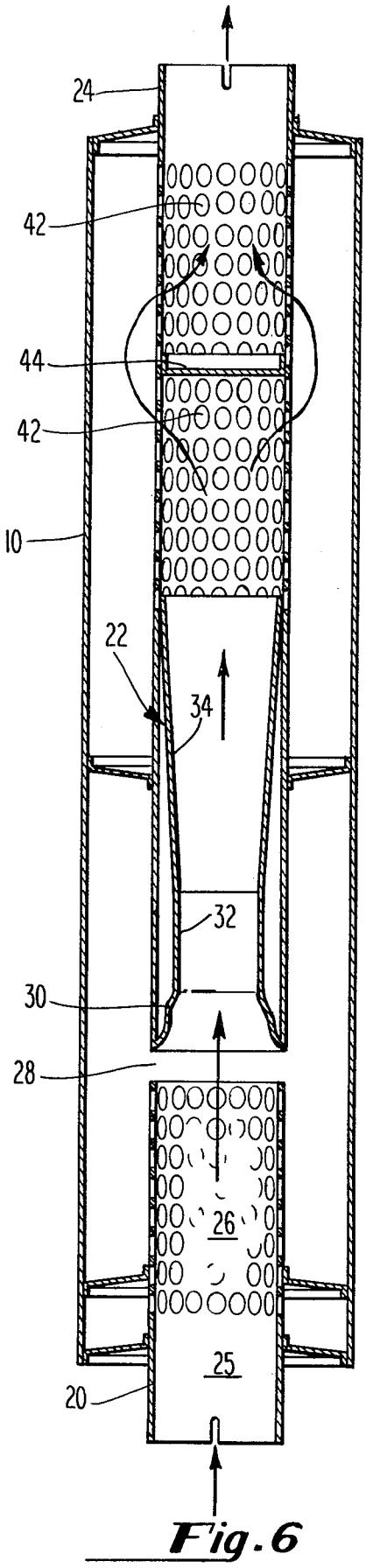

A third embodiment of the invention is shown in FIG. 6. Again, the muffler comprises an outer shell 10 and inlet and outlet tubes 20 and 24, respectively. The inlet tube 20 is perforated as at 26, and is separated from a venturi 22 by a gap 28. The venturi 22 again comprises a bell reducer 30, a straight section 32, and a gradual diffuser 34, and is immediately followed by a section of perforated tube 42. However, in the embodiment of FIG. 6 the relative dimensions of the straight section 32 and the diffuser 34 are comparatively short and the section of tube 22 having the perforations 42 is comparatively long, and contains a block 44 forcing the exhaust gases to pass out of a first section of the perforate tube 42, flow around the block 44 and back into a second section of the perforate tube 42 so as to exit the muffler. Again, the block 44, together with the diffusion of gas flow through the perforations, provides an additional impedance and phase change to gas flow.

Figure 7:
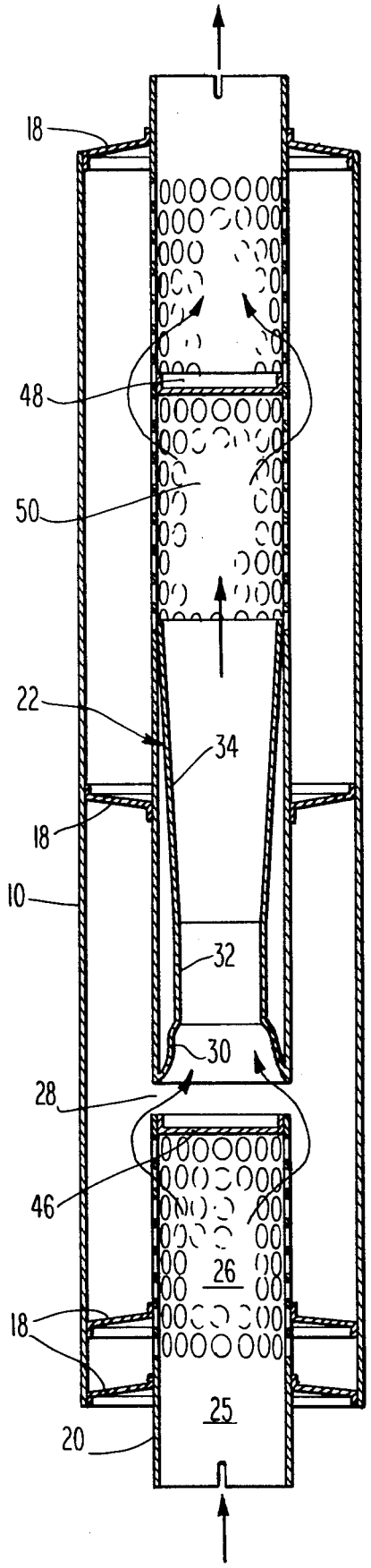

Finally, a fourth embodiment of the invention is shown in FIG. 7. This is essentially a combination of the embodiments of FIGS. 5 and 6, incorporating as it does a block 46 in the inlet tube 20 and a block 48 in a relatively long section 50 of perforated tube interposed after a comparatively short venturi section 22. Again the venturi section 22, comprising a reducing bell 30, a straight section 32 and a gradual diffuser 34 is separated by a gap 28 from the inlet section 20 which, as in the other embodiments of the invention comprises a tube 20 having a perforate section 26.

As is well known in the art, the size of the perforations and their relative spacing involves a trade-off between efficient attenuation of exhaust energy and allowance of flow of exhaust gas without substantial back pressure. Generally, where a perforated tube is fitted with a block such as 40 of FIG. 5, or 46 of FIG. 7, the less area of the tube removed by perforation, the better the attenuation accomplished, but the greater the back pressure produced. It will be understood by those skilled in the art of acoustics in general that a blocked solid-walled tube acts as a tuned resonator for a sound wave. Accordingly, the addition of perforations causes an impedance change in the tube and hence a phase change in the wave as well as attenuation of the overall sound level. Even in the embodiments of FIGS. 1 and 6, where flow through the inlet tube 20 is substantially straight-line, there being no block interposed at the outlet end of the tube 20, some attenuation due to the perforations takes place, while absence of the block serves to reduce back pressure as compared with a blocked perforated tube. Thus, for example, the low back pressure muffler of FIG. 1 might be chosen in a single muffler exhaust system, while the higher back pressure but better attenuating muffler of FIG. 5 might be used in a dual exhaust arrangement.

Comparative test data showing the efficacy of the venturi configuration according to the invention will now be presented. The first test, results of which are shown in Table I, involved comparative testing of an embodiment of the muffler of the invention according to FIG. 5 with and without the straight section 32 interposed between the reducing bell 30 and the diverging section 34; the tests were performed on a conventional Detroit Diesel engine model 8V-92T.

TABLE I

| | Without Improvement | With Improvement |
|---|---|---|
| Back Pressure: | 28.5" $H_2O$ | 28.6" $H_2O$ |
| Noise Level @ rpm: | | |
| 2100 | 74 dB(A) | 71.6 dB(A) |
| 1800 | 72 dB(A) | 70.5 dB(A) |
| 1600 | 73.5 dB(A) | 71.5 dB(A) |
| 1500 | 73 dB(A) | 70.5 dB(A) |
| Under Acceleration | 74 dB(A) | 72.0 dB(A) |

As will be evident from examination of the test results, the addition of the straight section 32 yielded an average improvement of some 2 dB(A), without substantial change in back-pressure. As will be understood by those skilled in the art, the increased attenuation of 2 dB(A) represents a decrease in overall noise of approximately one third, and is a significant and useful improvement. It will be noted in particular that at the 2100 rpm rated speed of this engine, the speed at which it is run under typical cruising conditions, the reduction is a full 2.4 dB(A) which is quite substantial and results in improved driver comfort as well as reduction in public disturbance.

A second test was performed on the muffler of the invention, again in an embodiment corresponding to FIG. 5, except that the diameter of the inlet tube 26 was substantially equal to the diameter of the inlet of the reducing bell 30, as shown in FIG. 7. The size and spacing of the perforations remained constant, thus reducing the back pressure by increasing the total area of the tube removed. Results are shown in Table II. The left column of test results represents tests on this muffler with the bell 30 connected directly to the diffuser 34, while the right column shows results with the straight section 32 imposed therebetween. The tests were performed on the same Detroit Diesel 8V-92T engine.

TABLE II

| | Without Improvement | With Improvement |
|---|---|---|
| Back Pressure: | 28.3" $H_2O$ | 27.7" $H_2O$ |
| Noise Level @ rpm: | | |
| 2100 | 72.2 dB(A) | 71 dB(A) |

TABLE II-continued

| | Without Improvement | With Improvement |
|---|---|---|
| 1800 | 69 dB(A) | 68.5 dB(A) |
| 1600 | 69.5 dB(A) | 69 dB(A) |
| 1500 | 69.5 dB(A) | 69 dB(A) |
| Under Acceleration | 72.1 dB(A) | 71.1 dB(A) |

It will be noted that the decrease is not quite as great as shown in the test of the embodiment of FIG. 5, but there is still a significant reduction in overall noise level. The results shown in Table I are not directly comparable to those of Table II, since the outer diameter of the housings 10 were nine and ten inches, respectively.

Finally, a third test was performed on a composite muffler having a venturi tube of the type described in Rowley et al. U.S. Pat. No. 3,672,464 referred to above. That venturi tube features a reducing bell 23 connected directly to a diffuser 25 without a straight section. The Rowley et al. muffler is, however, unlike those described by the present invention in that the flow is divided so that a fraction of the exhaust gases flow through the bell and diffuser, and the remainder through a perforated tube enclosing the reducer and diffuser. The gases are thereafter recombined in a second perforated tube 16. To remove the effect of this flow division from the tests, the perforated tube was eliminated. For these tests, a first test was performed on a muffler similar to that described in connection with FIG. 5 but using a venturi tube as indicated in FIG. 1 of the Rowley et al. patent. For a second test, the venturi tube of Rowley et al. was modified by addition of a $1\frac{1}{2}$ inch long section of straight tubing between the bell 23 and the diffuser 25, a like amount being subtracted from the overall length of the perforated section of tube 16. A third test was then performed with a $3\frac{1}{2}$ inch section of straight tubing inserted between the reducing bell 23 and the diffuser 25, a like amount being substracted from the length of the perforated tube 16. The results were as follows:

TABLE III

| | Venturi of 3,672,464 | With $1\frac{1}{2}''$ straight section | With $3\frac{1}{2}''$ straight section |
|---|---|---|---|
| Noise Level | | | |
| at rated rpm | 70 dB(A) | 68.9 dB(A) | 68 dB(A) |
| Acceleration | 74.5 dB(A) | 69.1 dB(A) | No test |

It will be observed that the addition of a straight section between reducer and diffuser, reduced the noise level quite substantially. Moreover, it may be concluded from comparison of the second and third tests that the longer the straight section, the better.

It will be appreciated that there has been described a muffler for an internal combustion engine which satisfies the object of the invention and needs of the art mentioned above. It is relatively simple and straightforward to manufacture, is inexpensive, and provides improved noise attenuation qualities over the prior art. Moreover, this is accomplished without substantial increase in back pressure and attendant loss in engine efficiency. Further, it will be appreciated that while the invention has been described with respect to several preferred embodiments of mufflers, the discovery of the utility of the venturi construction according to the invention may well have utility in other noise muffling applications not specifically discussed. Accordingly, it is submitted that the scope of the invention should not be defined by the disclosure above, which is merely exemplary, but only by the following claims.

I claim:

1. A muffler for an internal combustion engine comprising:

a housing defining an inlet end and an outlet end;

an inlet tube passing through the inlet end of the housing;

a venturi section disposed within said housing and axially spaced from said inlet tube, defining a passage for gases substantially smaller in cross-section than said housing and aligned generally axially with respect to said outlet end, comprising:

a reducing bell forming the inlet of said venturi section communicating with said inlet tube for reducing the effective cross-sectional area of said passage to at most about half its original size;

a straight section of tube of invariant cross-section coupled to the outlet end of said reducing bell;

a gradual diffusing tube connected to the outlet end of said straight section and increasing the effective diameter of said passage to substantially the original inlet diameter of said reducing bell;

a perforate section of tube axially connecting said diffusing tube with the outlet defined by said housing, wherein substantially all said gases pass through said venturi section; and a plurality of imperforate baffles interposed between said housing and said inlet tube, said venturi section, and said perforate tube, dividing the interior of said muffler into a plurality of sealed chambers, the end of said inlet tube in said muffler and the inlet of said venturi section both being disposed in the same one of said chambers.

2. The muffler of claim 1 further comprising an inlet tube comprising a perforate section of tube, said inlet tube being disposed within said housing and interposed between the inlet of said housing and said reducing bell, an axial gap being defined between said perforate section of said inlet tube and said reducing bell.

3. The muffler of claim 2 further comprising a block in said perforate section of tube communicating with said diffusing tube and said outlet, being disposed intermediate its ends.

4. The muffler according to either of claims 2 or 3 wherein said inlet tube further comprises a block at the end of the perforate section of said inlet tube.

5. A muffler for an internal combustion engine comprising a housing defining an inlet end and an outlet end, a section of perforate tube within said housing and connected to said inlet end, and a generally tubular, substantially straight line venturi section through which substantially all exhaust gases are constrained to pass, said venturi section comprising a reducing section forming the inlet of said venturi in which the cross-sectional area of said venturi is reduced from an initial value to not more than approximately half said initial value, a straight section of substantially constant cross-sectional area coupled to the outlet of said reducing section, and a diffusing section coupled to the outlet end of said straight section, for increasing the cross-sectional area of said venturi section substantially to said initial value, the reducing section of said venturi section being separated from said section of perforated tube by an axial gap, the interior of said muffler being divided into a plurality of chambers with the end of the section of said perforated tube within said housing and the end of the reducing section being in the same one of said chambers.

6. The muffler of claim 5 wherein the axial length of said diffusing section is at least about three times as great as the length of said straight section.

7. The muffler of claim 5 wherein the outlet end of said diffusing section is coupled to a second perforate section of tube coupled to the outlet of said muffler.

* * * * *